United States Patent [19]

Skomal

[11] 4,345,254

[45] Aug. 17, 1982

[54] REENTRY VEHICLE RADAR CROSS SECTION SIGNATURE MODIFICATION

[75] Inventor: Edward N. Skomal, Redlands, Calif.

[73] Assignee: The United States of America as represented by the Secretary of the Air Force, Washington, D.C.

[21] Appl. No.: 563,261

[22] Filed: Apr. 1, 1975

[51] Int. Cl.[3] ..... H01Q 15/00

[52] U.S. Cl. ..... 343/18 B; 343/18 E

[58] Field of Search ..... 343/18 A, 18 B, 18 E

[56] References Cited

U.S. PATENT DOCUMENTS

| | | | |
|---|---|---|---|
| 3,230,531 | 1/1966 | Bischoff et al. | 343/18 B X |
| 3,334,345 | 8/1967 | Bradford | 343/18 B |
| 3,413,636 | 11/1968 | Migdal | 343/18 B X |
| 3,792,477 | 2/1974 | Tomiyasu | 343/18 E |
| 3,900,849 | 8/1975 | Scott et al. | 343/18 B X |
| 3,997,899 | 12/1976 | Rolsma | 343/18 A |
| 4,047,174 | 9/1977 | Wohlers | 343/18 B |
| 4,148,032 | 4/1979 | Kelly et al. | 343/18 B |

*Primary Examiner*—T. H. Tubbesing

*Attorney, Agent, or Firm*—Donald J. Singer; Frank J. Lamattina

[57] ABSTRACT

An improvement to a reentry vehicle of the type which does not have a metallic substructure contiguous to the internal surface of the porous, dielectric heatshield thereof, whereby the radar cross section signature in the "nose-on" aspect region of the reentry vehicle can be controlled, individualized, and otherwise modified to confuse and/or to deceive the hostile tracker thereof. The improvement comprises, in essence, of a plurality of zones which are made of electrically conductive material and which are disposed on, and are fixedly positioned partially within (i.e., partially penetrate), the porous dielectric non-ablating internal surface layer of the heatshield by use of vacuum metal diffusion. The zones are spaced non-uniformly in the direction of the geometric axis of the reentry vehicle, and destroy (via scattering) uniformly occurring reflections which arise internally at the inner surface of the heatshield and which are caused by the incidence of the incoming and trapped waves at angles greater than the critial value of the material of which the inner surface is made.

8 Claims, 2 Drawing Figures

REENTRY VEHICLE RADAR CROSS SECTION SIGNATURE MODIFICATION

STATEMENT OF GOVERNMENT INTEREST

The invention described herein may be manufactured and used by or for the Government for governmental purposes without the payment of any royalty thereon.

BACKGROUND OF THE INVENTION

This invention relates to a reentry space vehicle (hereinafter referred to as "reentry vehicle") and, more particularly, to a modification thereof to alter or otherwise change the radar cross section (hereinafter referred to as "RCS") signature, i.e., radar return signal, thereof.

It is to be understood that the term "reentry vehicle", as used herein, is intended to mean a space vehicle which is not only capable of being launched into (and existing airborne in) space, but which is also capable of successfully reentering the earth's atmosphere. It is also to be noted that reentry vehicles normally have an integrated heatshield, including an external ablating surface layer.

It is very well known in the reentry vehicle art that an identifying static RCS signature exists for each class of integrated heatshield reentry vehicle built with a contiguous metallic substructure beneath the heatshield. Equally well known is the fact that significant modification (i.e., change or alteration) of any individual metallic substructured reentry vehicle's RCS signature has been impossible for many reasons, but primarily because of the contiguous metallic substructure, which is sometimes referred to as the reentry vehicle's "metal shell". However, it is here to be noted that reentry vehicles can be built without this "metal shell".

Irrespective of whether the reentry vehicle has or does not have a "metal shell", there exits a genuine need in the reentry vehicle art, particularly as a matter of national defense and the use of reentry vehicle decoys in conjunction therewith, for an integrated heatshield reentry vehicle whose RCS return or "signature" (i.e., pattern) in the "nose-on" aspect region can be controlled, individualized, or otherwise modified to confuse and/or to deceive the hostile tracker thereof.

I have invented an improvement applicable to any reentry vehicle of the type which is constructed without a contiguous metal structure beneath (i.e., internal of) the heatshield; and, thereby, I have fulfilled this existing need, and have therefore significantly advanced the state-of-the-art.

SUMMARY OF THE INVENTION

This invention pertains to a novel improvement to one type of reentry vehicle which said improvement causes an individualized RCS signature in the "nose-on" aspect region, wherein said RCS signature is not identifiable with the actual structure of the reentry vehicle, thereby making the reentry vehicle useable as a decoy.

Therefore, the principal object of this invention is to provide a significant improvement for a reentry vehicle and, thereby, to solve a long-standing problem in the space art.

This principal object, and other equally important and related objects, of my invention will become readily apparent after a consideration of the description herein of the invention, coupled with reference to the Figures of the drawing.

DESCRIPTION OF THE PREFERRED EMBODIMENT

Figure 1:
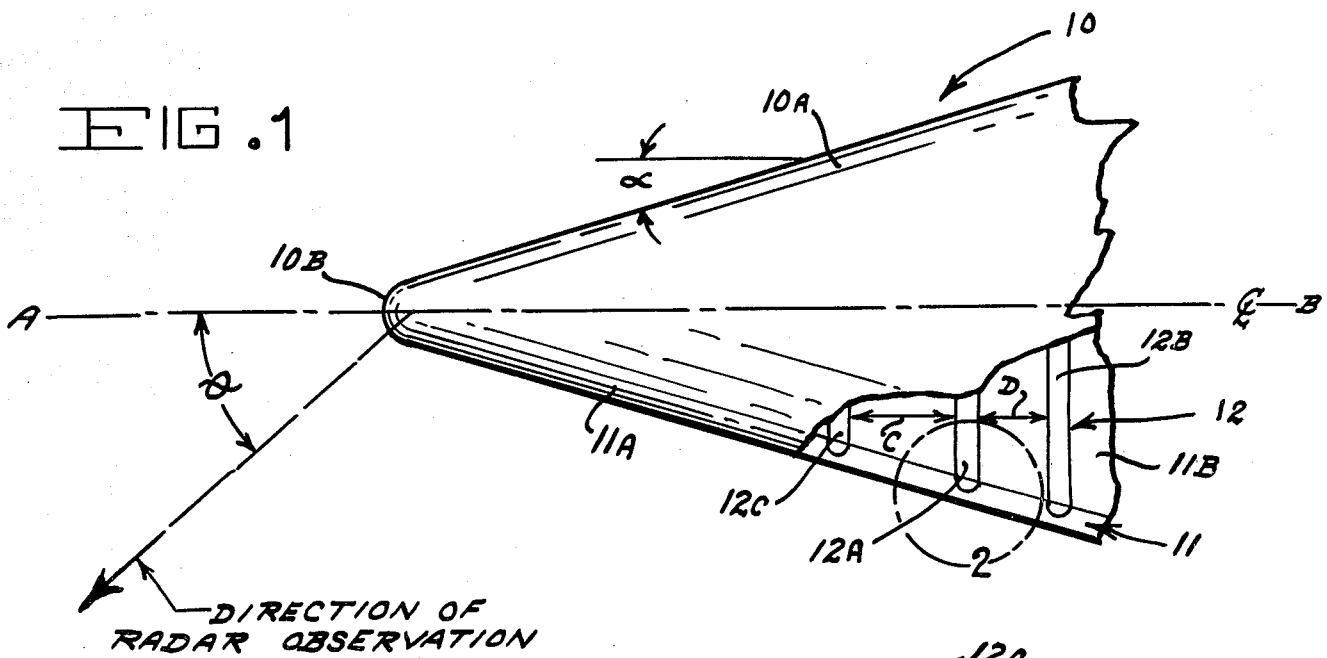
FIG. 1 is a side elevation view, partially fragmented and partially in cross section, in simplified form of a reentry vehicle in the heatshield of which is incorporated a preferred embodiment of my inventive improvement; and, FIG. 2 is a perspective view, fragmented, in cross section, and enlarged, of a representative significant portion of my inventive improvement, as identified in FIG. 1 by circular line (i.e., circle) 2.

With reference to FIG. 1, therein is shown a reentry vehicle 10 of the type which does not have a contiguous metal substructure (i.e., a "metal shell") beneath (i.e., internal of) the heatshield 11. The reentry vehicle 10 has a geometric axis, A-B; a nose portion 10A; and a nose 10B. The heatshield 11 of the reentry vehicle 10 is of porous, dielectric material(s) and includes an external ablating surface layer 11A, and an internal non-ablating surface layer 11B.

Also shown in FIG. 1 are: the angle $\theta$ which is the "radar aspect angle" or "angle of observation"; a representative direction of radar observation, legended and designated by a directional arrow; and, the angle $\alpha$ which is the angle of attack of the nose portion 10A (and, of course, of the nose 10B) of the reentry vehicle 10.

It is to be noted that, when angle $\theta=0$, the radar and/or radar observer is on a "nose-on" position (i.e., is located on and along geometric axis A-B of reentry vehicle 10).

My improvement, generally designated 12 in FIG. 1, comprises, in essence, a plurality of zones, such as representative ones 12A, 12B and 12C, which are made of electrically conductive material and which are disposed on, and are fixedly positioned partially within, the porous dielectric non-ablating internal surface layer 11B of the nose section 10A of the reentry vehicle 10. The zones, such as representative ones 12A, 12B and 12C, are spaced non-uniformly in the axial (i.e., A to B) direction. Such non-uniform spacing is shown by the representative different distances "C" (between zones 12C and 12A) and "D" (between zones 12A and 12B).

The zones may be, but need not be, of uniform width and depth (i.e., penetration into heatshield non-ablating layer 11B). The length (i.e., the perimeter) of the zones usually will not be the same, since the zones may be endless, and further since the cross section of the nose section 10A made by a plane perpendicular to geometric axis A-B of the normally conical shaped reentry vehicle, at various points along axis A-B, will limit and define a circle, with each said circle being of a different circumference.

Figure 2:
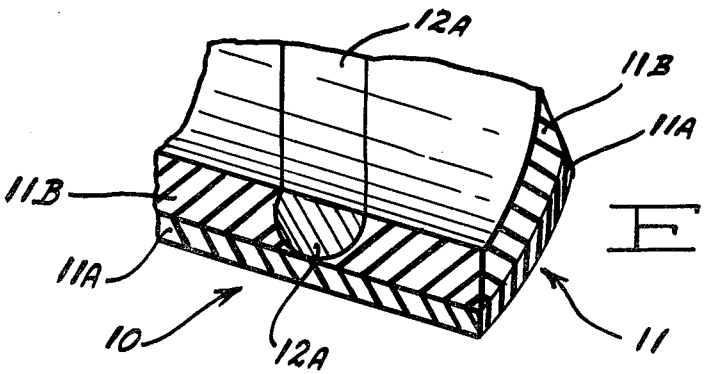

Now, with reference to FIG. 2 which is an enlarged view of the representative portion of my inventive improvement 12 and of reentry vehicle 10, previously identified in FIG. 1 by the circle designed with the reference numeral 2, therein are shown in their relative positional relationship: heatshield 11; external ablating surface layer 11A; porous internal non-ablating surface layer 11B; and, representative conductivity zones 12A of the plurality of said zones. One can readily see that the zone 12A only partially penetrates internal non-ablating surface layer 11B.

MANNER OF OPERATION OF THE PREFERRED EMBODIMENT

The principle of operation of my inventive improvement, and of the preferred embodiment 12 thereof, is based upon the finding that the use of diffusion produced zones (such as can be made by and with the use of vacuum metal diffusion from the interior of the heatshield 11) can destroy, via scattering, any and all uniformly occurring reflections which arise internally at the inner surface of the heatshield and which are caused by the incidence of the incoming and trapped waves at angles greater than the critical value of the material (such as quartz phenolic which has a critical value of from 30 degrees to 33 degrees) of which that inner surface is made. The non-uniform spacing of the higher conductivity zones individualizes the refraction and internal reflection pattern.

If the heatshield non-ablating layer is made of quartz phenolic, and if the zones have a conductivity of approximately 3 mhos/cm, maximum depths of 4 mm, and axial spacings in multiples of 7.5 mm, then the RCS signature between 0 degrees to $\pm 30$ degrees from "nose-on" (i.e., $\theta=0$) at and below C-band can be substantially altered from vehicle-to-vehicle and most certainly will be deceptive. Alternatively and equivalently, roll asymmetric higher conductivity zones individually spaced will produce individual vehicles static RCS signatures.

CONCLUSION

It is clearly evident from all of the foregoing, and from FIGS. 1 and 2, that the principal object of my invention has been attained.

It is to be noted that, although there have been described the fundamental and unique features of my inventive improvement as applied to a preferred embodiment, various other embodiments, adaptations, substitutions, additions, omissions, and the like will occur to, and can be made by, those of ordinary skill in the art, without departing from the spirit of my inventive improvement.

What is claimed is:

1. In a reentry vehicle having a geometric axis and an integrated heatshield made of porous dielectric material, wherein the heatshield has an external ablating surface layer and an internal non-ablating surface layer, and wherein the reentry vehicle is of the type not having a metallic substructure contiguous to and internal of the heatshield, the improvement comprising a plurality of zones having depth, width, and length and made of electrically conductive material disposed on and partially penetrating the internal non-ablating surface layer of the heatshield, with said zones spaced non-uniformly with respect to said axis.

2. The improvement, as set forth in claim 1, wherein each of said plurality of zones is of a different depth.

3. The improvement, as set forth in claim 1, wherein each of said plurality of zones if of the same depth.

4. The improvement, as set forth in claim 1, wherein each of said plurality of zones is of a depth not exceeding 4 millimeters.

5. The improvement, as set forth in claim 1, wherein each of said plurality of zones is of a different width.

6. The improvement, as set forth in claim 1, wherein each of said plurality of zones if of the same width.

7. The improvement, as set forth in claim 1, wherein each of said plurality of zones if of a different length.

8. The improvement, as set forth in claim 1, wherein each of said plurality of zones is spaced at intervals which are different multiples of 7.5 millimeters.

* * * * *